United States Patent [19]

Thoma

[11] 4,006,859

[45] Feb. 8, 1977

[54] FUEL INJECTION NOZZLE FOR INTERNAL COMBUSTION ENGINES

[75] Inventor: Frank Thoma, Stuttgart, Germany

[73] Assignee: Daimler-Benz Aktiengesellschaft, Germany

[22] Filed: Aug. 27, 1975

[21] Appl. No.: 608,345

[30] Foreign Application Priority Data

Aug. 31, 1974 Germany ..... 2441841

[52] U.S. Cl. ..... 239/89; 239/533.8

[51] Int. Cl.[2] ..... B05B 1/30

[58] Field of Search ..... 239/88, 89, 92, 533, 239/93, 96

[56] References Cited

UNITED STATES PATENTS 2,055,580 9/1936 Larsson et al. ..... 239/89 X 3,813,044 5/1974 Westenberger ..... 239/533

*Primary Examiner*—Evon C. Blunk
*Assistant Examiner*—Michael Mar
*Attorney, Agent, or Firm*—Craig & Antonelli

[57] ABSTRACT

A fuel injection nozzle for internal combustion engines with a nozzle needle movably guided in a nozzle body, which supplies fuel metered by a metering device under pressure to the combustion space by way of at least one injection bore; a servo-piston is thereby provided on the actuating side of the nozzle needle which is guided intermittently actuatable and displaceable against the force of a spring in the injection direction by a pressure medium.

11 Claims, 1 Drawing Figure

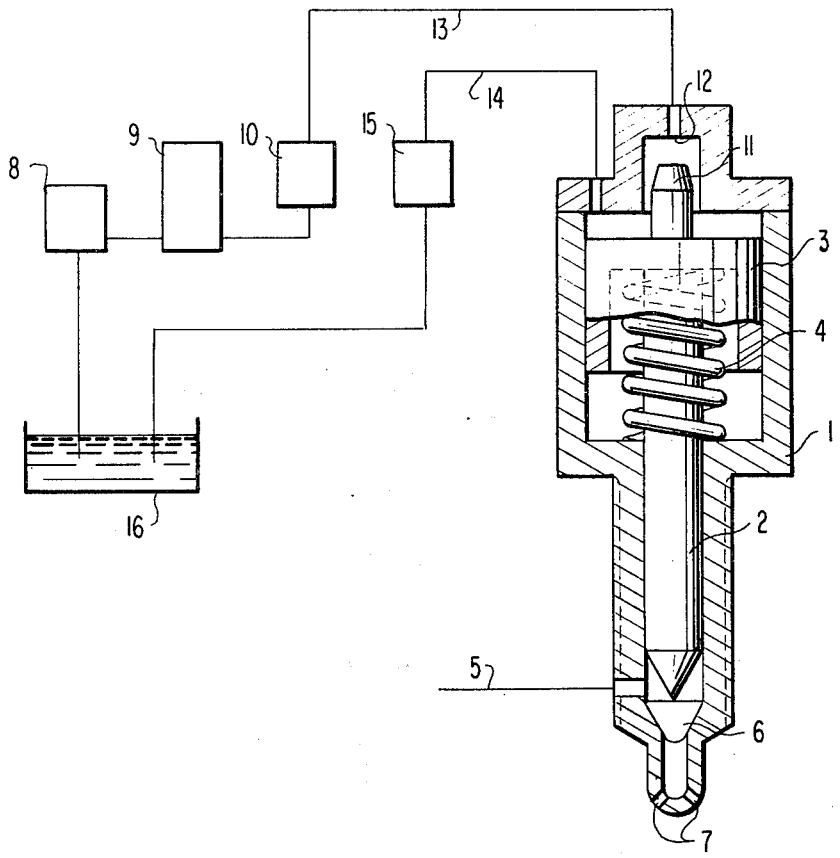
13
14
12
11
9
10
15
8
3
4
1
16
2
5
6
7

FUEL INJECTION NOZZLE FOR INTERNAL COMBUSTION ENGINES

The present invention relates to a fuel injection nozzle for internal combustion engines with a nozzle needle or nozzle pin movably guided in a nozzle body, which feeds the fuel metered by a metering device under pressure to the combustion space by way of at least one injection bore.

Disadvantages result with the hitherto customary fuel injection nozzles in that during opening and closing of the nozzle, i.e., at a slight spacing of the nozzle needle from the sealing seat, the flow between the needle and the seat is throttled and thus leaves the injection bores with only a low velocity. As a consequence thereof, there occurs a poor atomization of the fuel and as a result thereof, an unfavorable combustion with increased fuel consumption and increased harmful components in the exhaust gas. The seat-throttle-phase during the closing of the nozzle is additionally lengthened by the after-pumping of the nozzle needle or pin which occurs during the closing stroke as a result of the displacement effect of the nozzle needle.

It has already been attempted to avoid the described disadvantages in that the nozzle needle is positively controlled in such a manner that it is displaced by a rocker arm actuated from the engine cam shaft against the force of a return spring. During the compression stroke, the nozzle needle is raised and the fuel quantity to be injected is thereby supplied to the pressure space between the raised needle and injection bore in the nozzle body by way of a metering device. The air simultaneously entering into the pressure space through the injection bore in case of single hole nozzles or through injection bores in case of multi-hole nozzles as a result of the compression operation, prevents a premature discharge of fuel into the combustion space. During the injection beginning, the nozzle needle is displaced downwardly whereby it still has such a large spacing from the sealing seat that no seat-throttling occurs. In contradistinction thereto, seat-throttling still occurs at the end of the injection since at that time the nozzle needle closes the injection bores only slowly. This is in particular so because the feed velocity is low prior to the injection end as according to the principles of a cam drive, the feed velocity prior to the stroke end can approach zero only with limited velocity.

The present invention is therefore concerned with the task to provide a fuel-injection nozzle with structurally simple means which are simple also from a manufacturing point of view whereby simultaneously the aforementioned disadvantages can be avoided.

The underlying problems are solved according to the present invention in that the nozzle needle or pin includes a servo-piston on its driving side which is intermittently actuatable and displaceably guided in the injection direction by a pressure medium against the force of a spring.

In order to attain a predetermined progress of the velocity of the servo-piston which is favorable for the combustion and therewith of the injection velocity, the top of the servo-piston is provided with a profile needle or pin which at least at the beginning of the working stroke immerses into the discharge of the pressure medium supply line.

It is of particular advantage if fuel is used as pressure medium, whereby a pump is provided as pressure producer, which feeds a pressure reservoir or tank whereby a control valve is connected downstream of this reservoir or tank.

For the purpose of a rapid pressure medium return after the injection end, a line leads from the pressure space above the servo-piston top into a pressureless vessel or tank whereby a valve controlling the beginning of the return flow is arranged in the line.

Accordingly, it is an object of the present invention to provide a fuel injection nozzle for internal combustion engines which avoids by simple means the aforementioned shortcomings and drawbacks encountered in the prior art.

Another object of the present invention resides in a fuel injection nozzle for internal combustion engines, in which no significant throttling occurs as regards the flow between the needle and the seat during the opening and closing of the nozzle.

A further object of the present invention resides in a fuel injection nozzle for internal combustion engines in which an inadequate velocity of the flow of the fuel discharged through the injection bore or bores is far-reachingly avoided.

Still a further object of the present invention resides in a fuel-injection nozzle for internal combustion engines which results in improved atomization of the fuel and therewith in a more favorable combustion with reduced fuel consumption and reduced harmful components in the exhaust gases.

Still another object of the present invention resides in a fuel injection nozzle for internal combustion engines which is simple in construction, can be readily manufactured and avoids the disadvantages described hereinabove.

A further object of the present invention resides in a fuel injection nozzle for internal combustion engines in which a favorable progress of the injection velocity is assured.

These and other objects, features, and advantages of the present invention will become more apparent from the following description when taken in connection with the accompanying drawing which shows, for purposes of illustration only, one embodiment in accordance with the present invention, and wherein:

The single FIGURE is a schematic view of a fuel injection system including an injection nozzle, shown in cross section, in accordance with the present invention.

Referring now to the single FIGURE of the drawing, a nozzle needle or pin 2 is movably arranged in a nozzle body 1. The nozzle needle 2 includes on its driving or actuating side a servo-piston 3 which is under the influence of a spring 4. The fuel metering for the combustion takes place by means of a conventional metering installation (not shown) by way of a line 5 into the pressure space 6 between the nozzle needle 2 and the injection bores 7 whereby a premature fuel outflow or discharge is prevented by the compression pressure which is building up.

In the starting position, the top surface of the servo-piston 3 abuts in the nozzle body 1 at the upper end face under the influence of the spring 4. Fuel may be utilized as pressure medium for the hydraulic actuation.

The pressure medium is pumped by a pressure producer 8 into a pressure reservoir or storage device 9; a hydraulically, electrically or mechanically actuated control valve 10 of any conventional construction is connected downstream of the pressure tank 9. By means of the control valve 10, also the injection beginning—in relation to the upper dead center point of the engine piston—is determined by the determination of the actuating instant.

The top of the servo-piston 3 is provided with a profile needle or pin 11 which immerses at least at the beginning of the working stroke into the discharge 12 of the pressure medium supply line 13 whereby a predetermined progress favorable for the combustion can be imparted on the velocity of the servo-piston 3 and therewith also on the injection velocity. The needle 11 thereby throttles corresponding to its profile the pressure medium supply and therewith determines the progress of the downward velocity of the servo-piston 3 and of the nozzle needle 2 during the injection stroke.

At the injection end, the return of the nozzle needle 2 together with the servo-piston 3 takes place by means of the spring 4, whereby the pressure medium is returned into a pressureless tank 16 from the space above the top of the servo-piston 3 by way of a line 14 with a valve 15 connected downstream thereof which controls the beginning of the return flow.

It is achieved altogether by the construction according to the present invention that the nozzle needle 2 is able to seat with full velocity on the sealing seat so that at the end of the injection operation, a very short seat-throttle-phase results with a large feed velocity.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What is claimed is:

1. A fuel injection nozzle for internal combustion engines which comprises a nozzle needle means displaceably guided in a nozzle body means, the nozzle needle means being operable to feed fuel, metered by a metering means, under pressure to a combustion space by way of at least one injection bore means, the nozzle means being displaceably guided from a first position spaced from the bore means to a second position sealing the bore means and terminating the injection, characterized in that a pressure space means communicating with the metering means is provided for accommodating the fuel to be injected, said pressure space means is defined between the injection bore means and the nozzle needle means when said nozzle needle means is in the first position, the nozzle needle means includes on its actuating side a servo-piston means which is guided intermittently actuatable and displaceable against the force of a spring in the injection direction by a pressure medium.

2. A fuel injection nozzle according to claim 1, characterized in that a pump means is provided as pressure producer which feeds into a pressure storage means, a control valve means being connected downstream of the pressure storage means in a pressure medium supply line.

3. A fuel injection nozzle for internal combustion engines which comprises a nozzle needle means displaceably guided in a nozzle body means, the nozzle needle means being operable to feed fuel, metered by a metering means, under pressure to a combustion space by way of at least one injection bore means, characterized in that the nozzle needle means includes on its actuating side a servo-piston means which is guided intermittently actuatable and displaceable against the force of a spring in the injection direction by a pressure medium, and in that the top of the servo-piston means is provided with a profile needle means which at least at the beginning of the working stroke valves the discharge of a pressure medium supply line.

4. A fuel injection nozzle according to claim 3, characterized in that fuel is used as pressure medium.

5. A fuel injection nozzle according to claim 4, characterized in that a pump means is provided as pressure producer which feeds into a pressure storage means, a control valve means being connected downstream of the pressure storage means in the pressure medium supply line.

6. A fuel injection nozzle according to claim 5, characterized in that a line leads from the pressure space above the top of the servo-piston means into a substantially pressureless container, and a valve means being arranged in said last-mentioned line which controls the beginning of the return flow.

7. A fuel injection nozzle according to claim 6, characterized in that the profile needle means immerses into the discharge of the pressure medium supply line at least at the beginning of the working stroke of the servo-piston means.

8. A fuel injection nozzle according to claim 3, characterized in that the profile needle means immerses into the discharge of the pressure medium supply line at least at the beginning of the working stroke of the servo-piston means.

9. A fuel injection nozzle for internal combustion engines which comprises a nozzle needle means displaceably guided in a nozzle body means, the nozzle needle means being operable to feed fuel, metered by a metering means, under pressure to a combustion space by way of at least one injection bore means, characterized in that the nozzle means includes on its actuating side a servo-piston means which is guided intermittently actuatable and displaceable against the force of a spring in the injection direction by a pressure medium, and in that fuel is used as pressure medium.

10. A fuel injection nozzle for internal combustion engines which comprises a nozzle needle means displaceably guided in a nozzle body means, the nozzle needle means being operable to feed fuel, metered by a metering means, under pressure to a combustion space by way of at least one injection bore means, characterized in that the nozzle needle means includes on its actuating side a servo-piston means which is guided intermittently actuatable and displaceable against the force of a spring in the injection direction by a pressure medium, a pump means is provided as pressure producer which feeds into a pressure storage means, a control valve means is connected downstream of the pressure storage means in a pressure medium supply line, and in that fuel is used as pressure medium.

11. A fuel injection nozzle for internal combustion engines which comprises a nozzle needle means displaceably guided in a nozzle body means, the nozzle needle means being operable to feed fuel, metered by a metering means, under pressure to a combustion space by way of at least one injection bore means, characterized in that the nozzle needle means includes on its actuating side a servo-piston means which is guided intermittently actuatable and displaceable against the force of a spring in the injection direction by a pressure medium, and in that a line leads from the pressure space above the top of the servo-piston means into a substantially pressureless container, and a valve means is arranged in said last-mentioned line which controls the beginning of the return flow.

* * * * *